US006644376B2

(12) United States Patent
Wielen

(10) Patent No.: US 6,644,376 B2
(45) Date of Patent: Nov. 11, 2003

(54) SINGLE CONTROL TILT DRIVE UNIT

(75) Inventor: Franciscus Johannes van der Wielen, Oosterhout (NL)

(73) Assignee: Hunter Douglas Industries B.V. (NL)

( * ) Notice: Subject to any disclaimer, the term of this patent is extended or adjusted under 35 U.S.C. 154(b) by 20 days.

(21) Appl. No.: 10/005,114

(22) Filed: Dec. 4, 2001

(65) Prior Publication Data

US 2002/0069978 A1 Jun. 13, 2002

(30) Foreign Application Priority Data

Dec. 4, 2000 (NL) ..... 1016786

(51) Int. Cl.[7] ..... E06B 9/30

(52) U.S. Cl. ..... 160/170 R; 160/176.1 R; 160/900

(58) Field of Search ..... 160/176.1 R, 176.1 V, 160/177 R, 177 V, 170 R, 171 R, 168.1 R, 168.1 V, 900, 405

(56) References Cited

U.S. PATENT DOCUMENTS

| | | | | |
|---|---|---|---|---|
| 2,113,933 A | | 4/1938 | Darling | 156/17 |
| 3,443,624 A | | 5/1969 | Toth | 160/107 |
| 5,699,845 A | * | 12/1997 | Jelic | 160/107 |
| 5,839,494 A | * | 11/1998 | Judkins | 160/167 R |

FOREIGN PATENT DOCUMENTS

| | | |
|---|---|---|
| CH | 679 689 | 3/1992 |
| DE | 29 13 885 | 10/1980 |
| DE | 33 13 833 | 10/1984 |
| GB | 1187214 | 4/1970 |
| GB | 2049006 | 12/1980 |
| NO | 129 284 | 9/1958 |
| SE | 157 839 | 2/1957 |

* cited by examiner

*Primary Examiner*—David Purol
(74) *Attorney, Agent, or Firm*—Dorsey & Whitney LLP

(57) ABSTRACT

A tilt drive unit for a horizontal or vertical venetian blind, operated by a common drive system. The tilt drive unit is designed to keep the blind slats in a titled-open position during extension or retraction of the slats. The tilt drive unit has a tilt roller that is connected to a drive shaft of the blind and has a track formation on its radially outer surface. The track formation has a pair of circumferential linear grooves and a convoluted groove, which can be engaged by a movable tilt member sliding within the grooves. The tilt member is attached to a mechanism for adjusting the angular position of the slats, such as the ends of a ladder cord. The convoluted groove is adapted to induce a translatory movement to the tilt member. The convoluted groove intersects each linear groove at an angled 3-way junction. The tilt member will only move from one of the linear grooves to the convoluted groove after a change of rotational direction of the tilt roller. The tilt member will move from the convoluted groove to one of the linear grooves also at an angled 3-way junction after about a full revolution of the tilt roller in the same direction.

14 Claims, 3 Drawing Sheets

SINGLE CONTROL TILT DRIVE UNIT

CROSS REFERENCE TO RELATED APPLICATION

This application claims priority to application Ser. No. 1016786 filed in The Netherlands on Dec. 4, 2000 under the title "Single Control Tilt Drive Unit."

BACKGROUND OF THE INVENTION

1. Field of the Invention

This invention relates to a monocommando tilt drive unit for a covering for an architectural opening, such as a venetian blind.

2. Description of the Relevant Art

Monocommando drive units for operating venetian blinds are known. See, for example, UK patents 1 187 214 and 2 049 006. Typically such mechanisms have been adapted to tilt, as well as open and close—i.e., raise and lower (for horizontal blinds) or extend and retract (for vertical blinds)—a plurality of mutually interconnected slats of a blind by means of a single common control device.

A disadvantage of existing monocommando devices for horizontal or vertical blinds is that when opening and closing such blinds, their slats are virtually closed. For horizontal blinds, this results in the apertures in the slats, for the passage of the lift cords, rubbing against the slats as the lift cords move through the apertures and causing wear and tear to the lift cords which can eventually break them.

SUMMARY OF THE INVENTION

In accordance with this invention, a tilt drive unit (A,A', A") is provided for a covering for an architectural opening, such as a venetian blind (C,C',D), which tilt drive unit includes (with reference to FIGS. 1–5):

- a roller (1,101,201) that has a circumferential track formation (5,105,205) on a radially outer surface thereof and is adapted to be rotatably driven; and
- a movable tilt member (3,4,103,104,203,204) that is engaged by the circumferential track formation (5,105,205) on the roller (1,101,201) for sliding movement in the track formation and is operatively engaged with means (6,7,106,107,234,235) to tilt slats (B,B', B") of the covering (C,C',D);
- wherein the track formation (5,105,205) has a free zone (12,112,212) and a tilt zone (13,113,213), whereby when the tilt member (3,4,103,104,203,204) is engaged by the free zone, the slats of the blind will be retained in an open position and whereby when the tilt member is engaged by the tilt zone, rotation of the roller (1,101,201) will cause the slats of the blind to be tilted to either of two opposite positions of tilt.

This tilt drive unit allows the slats of a venetian blind to be opened and closed, while the slats are open (thereby allowing the lift cords in a horizontal venetian blind to run freely through the apertures in the slats). This tilt drive unit is also considered easier to assemble and operate and less expensive to manufacture than other monocommando devices for venetian blinds.

BRIEF DESCRIPTION OF THE DRAWINGS

Further aspects of the invention will be apparent from the detailed description below of a particular embodiment and the drawings thereof, in which.

DESCRIPTION OF THE PREFERRED EMBODIMENTS

Figure 1:
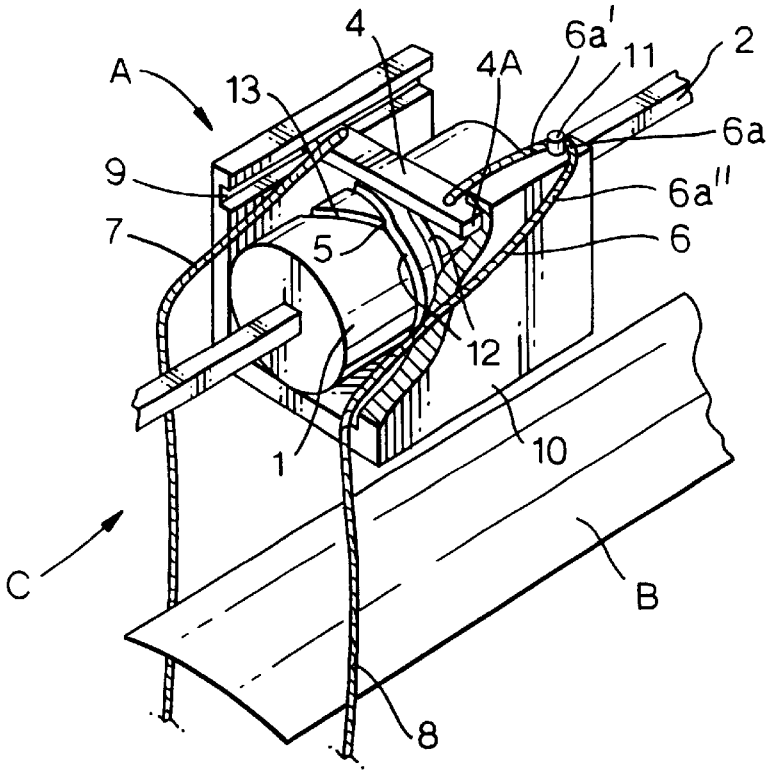
FIG. 1 is a perspective view of a first embodiment of a tilt drive unit of this invention (with parts broken away) for use in a horizontal venetian blind.
Figure 2:
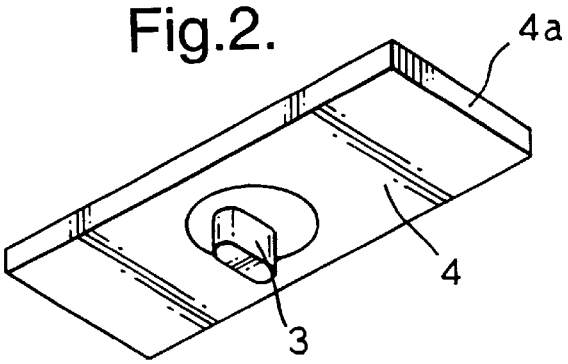
FIG. 2 is a perspective view of the bottom of a movable cord transport member of the first embodiment of the tilt drive unit, shown in FIG. 1; the flat bottom end of a tilt pin 3 on the cord transport member is shown with its longer axis extending in a direction which is perpendicular to the direction, in which the axis normally extends when it engages a circumferential track on a roller of the tilt drive unit.
Figure 3:
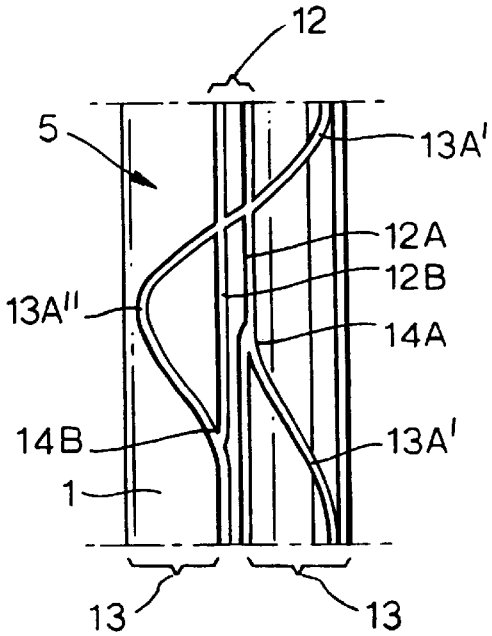
FIG. 3 is a developed view of the first embodiment of the tilt drive unit, shown in FIG. 1, showing its grooved circumferential track.

FIGS. 1–3 show a first embodiment A of a tilt drive unit of this invention for tilting the horizontal slats B of an otherwise conventional, horizontal venetian blind C and keeping the slats tilted open during raising and lowering of the blind. The tilt drive unit A has a tilt roller 1 that is connected to, and adapted to rotate with, a conventional longitudinally-extending drive shaft 2. The drive shaft 2 is coaxial with the tilt roller and adapted to raise and lower the longitudinally-extending horizontal slats B in a conventional manner upon rotation of the drive shaft in either of two opposite lateral directions. In this regard, conventional lift cords or tapes (not shown), on longitudinally opposite sides of the blind, can be connected to conventional spools (not shown), mounted on the drive shaft 2, and to a bottom rail (not shown) which can be raised and lowered by the lift cords or tapes, upon rotation of the spools with rotation of the drive shaft 2 in opposite lateral directions, to raise and lower the slats B. Similarly, conventional driving means (not shown), such as an operating ball chain or an electric motor (to take full advantage of the "monocommando"-tilt drive unit A), can be connected to a longitudinal end of the drive shaft 2 to turn it in opposite directions. Thus, the tilt drive unit A can be positioned in a head rail (not shown) of a blind, above its slats B, as a replacement for conventional tilt rollers and their supports.

Above the tilt roller 1 is a freely rotatable tilt pin 3 which is mounted underneath (as shown in FIG. 2) a movable tilt member 4 in the form of a laterally-extending, movable, cord transport member or bar 4 that is also above the tilt roller 1. The tilt pin 3 extends downwardly from the cord transport member 4, so that the tilt pin's bottom end is located in a grooved circumferential track formation 5 in the radially outer surface of the tilt roller 1. As shown in FIG. 3, the flat surface of the bottom end of the tilt pin 3 preferably has a generally oblong shape along its longer axis which will extend in the direction of travel of the bottom of the tilt pin in the track 5. During rotation of the tilt roller 1 with rotation of the drive shaft, the bottom of the tilt pin 3 engages the track 5 as it slides freely within and along the track 5, circumferentially around the tilt roller 1. In this regard, the tilt pin 3 can freely rotate about its vertical axis as it follows the track 5, so that the longer axis of its bottom end can stay generally parallel to the opposite sides of the track 5 as the bottom of the tilt pin moves between different portions of the track which are curved or angled, relative to one another.

The upper, laterally-opposite end portions 6 and 7 of a conventional ladder cord 8 are connected to the top of laterally opposite, end portions of the cord transport member 4 on laterally opposite sides of the tilt roller 1. The laterally opposite end portions of the cord transport member 4 are located in longitudinally-extending grooves 9 on laterally opposite sides of a rigid housing 10 which encloses the tilt roller 1 and is fixed to the blind. As seen from FIG. 1, each groove 9 in the housing 10 has a vertical cross-section that is rectangular and fits closely about one of the lateral end portions of the cord transport member 4. In this regard, each lateral end 4*a* of the cord transport member 4 is preferably rectangular. The grooves 9 allow the cord transport member 4 to be moved longitudinally (either to the left or right in FIG. 1) within the housing 10, with movement of the tilt pin 3 in the track 5 upon rotation of the tilt roller 1, without the cord transport member swiveling significantly laterally.

As seen in FIG. 1, an upstanding guide pin 11 is provided on one lateral side of the housing 10, preferably on top of the housing. The guide pin 11 is also located adjacent one longitudinal side of the housing 10, preferably adjacent one longitudinal end of the tilt roller 1. It is particularly preferred that the guide pin 11 is on the longitudinal side of the housing 10, remote from the adjacent longitudinal end of the blind. Of course, other guiding means, such as a wheel could, If desired, replace the guide pin 11 on the housing 10.

A loop 6*a* is formed in one of the upper end portions 6 of the ladder cord 8 (i.e., the front upper end portions of the ladder cord 8 as shown in FIG. 1), around the guide pin 11. As a result, the one ladder cord end portion 6 travels around the guide pin 11 with longitudinal movement of the cord transport member 4. As a result, the end most segment 6*a*′ of the one upper ladder cord end portion 6, between the guide pin 11 and the cord transport member 4, moves in the same longitudinal direction as the cord transport member moves while the adjacent segment 6*a*″ of the one ladder cord end portion 6, on the laterally opposite side of the guide pin 11, moves in the opposite longitudinal direction from the cord transport member 4. By comparison, the other upper ladder cord end portion 7 (i.e., the rear upper end portions of the ladder cord 8 as shown in FIG. 1) moves in the same longitudinal direction as the cord transport member 4 moves. Thus, longitudinal movement of the cord transport member 4 causes the one ladder cord end portion 6 to move in an opposite vertical direction from the other ladder cord end portion 7, causing the ladder cord 8 to tilt the blind slats B.

When the tilt roller 1 rotates with the drive shaft 2 in a first direction to raise or lower the blind slats B, this causes the bottom of the tilt pin 3 to move along laterally-extending portions or a free zone 12 of the circumferentially-extending track 5. The free zone 12 is preferably at about the longitudinal center of the track 5 and of the tilt roller 1. Thereafter, rotation of the tilt roller 1 in an opposite second direction causes the bottom of the tilt pin 3 to move from the laterally-extending free zone 12 to longitudinally- and laterally-extending, curved portions or a tilt zone 13 of the track 5. Continued rotation of the tilt roller 1 in the opposite second direction causes the bottom of the tilt pin 3 to continue to move in the longitudinally- and laterally-extending tilt zone 13, causing the cord transport member 4, together with the upper ends of the ladder cords 6, to be moved longitudinally inside the housing 10. This results in tilting of the slats B in a direction that depends on the second direction of rotation of the tilt roller 1. Thereafter, continuously rotating the tilt roller 1 in the second direction, to raise or lower the blind slats B, brings the bottom of the tilt pin 3, after approximately a full revolution of the tilt roller 1, back into the laterally-extending free zone 12 of the grooved circumferential track 5 as best seen in FIG. 3. Then, continued rotation of the tilt roller 1 in the second direction causes the bottom of the tilt pin 3 to continue to move in the free zone 12, thereby continuing to raise or lower the slats B with the slats tilted open.

As seen from FIGS. 1 and 3, the free zone 12 is formed by longitudinally adjacent, substantially parallel, first and second, laterally-extending linear grooves 12A and 12B of the track 5. Movement of the tilt pin 3 in the tree zone 12 in a first direction (resulting from rotation of the tilt roller 1 with the drive shaft 2 in the first direction) allows the slats B to remain in a tilted completely open position during raising and lowering of the blind slats. However, subsequent movement of the tilt pin 3 in the free zone 12 in an opposite second direction (resulting from rotation of the tilt roller 1 with the drive shaft 2 in the second direction) brings the tilt pin 3 into the tilt zone 13 of the track 5. The tilt zone 13 is formed by a single longitudinally- and laterally-extending convoluted groove 13A of the track 5 which extends on both longitudinal sides of the free zone 12. Movement of the bottom of the tilt pin 3 in the tilt zone 13 will cause the slats B to tilt to a desired slat orientation of either partially closed or completely closed and either slanted upwardly or downwardly relative to the architectural opening (e.g., the window).

As shown in FIG. 3, each of the laterally-extending linear grooves 12A, 12B in the free zone 12 of the track 5 has only one junction 14A and 14B, respectively, with the convoluted groove 13A of the tilt zone 13 where movement of the tilt pin 3 in the free zone 12 in an opposite second direction will result in the tilt pin 3 moving into the convoluted groove 13A of the tilt zone 13. Each of these single junctions 14A, 14B is configured in a conventional way as an angled 3-way junction to divert the bottom of the tilt pin 3 from each of the linear grooves 12A or 12B into the convoluted groove 13A of the tilt zone 13 in only one direction (i.e., the second direction) of rotation of the tilt roller 1 and thus only one direction of lateral movement of the bottom of the tilt pin 3 in the linear groove 12A or 12B—while keeping the bottom of the tilt pin 3 in the linear groove 12A or 12B in the opposite direction (i.e., the first direction) of rotation of the tilt roller and of lateral movement of the bottom of the tilt pin in its linear groove. In this regard, these single junctions 14A, 14B are configured to divert the bottom of the tilt pin 3 from the linear grooves 12A and 12B into the convoluted groove 13A in opposite directions of rotation of the tilt roller 1 (and of lateral movement of the bottom of the tilt pin). Thus, each junction 14A, 14B keeps the bottom of the tilt pin 3 from moving out of one of the linear grooves 12A,12B into the convoluted groove 13A, and thereby in a tilted-open position, in a direction of rotation of the tilt roller 1 that is the opposite of the direction of rotation of the tilt roller, for which the other junction 14B, 14A keeps the bottom of the tilt pin 3 from moving out of the other linear groove 12B, 12A into the convoluted groove 13A.

In operation of the tilt drive unit A (with reference to FIG. 3)—starting, for example, with the bottom of the tilt pin 3 being located in the right linear groove 12A (as shown in FIG. 3)—rotation of the tilt roller 1 in a first direction (with rotation of the drive shaft 2 in its first direction and movement of the driving means [not shown] in its first direction) which will move the bottom of the tilt pin moves upwardly in FIG. 3, will also result in the bottom of the tilt pin 3 moving only in the right linear groove 12A of the free zone 12 while the blind slats B will be in a tilted-open position (e.g., slanted upwardly) as they are moved in a first vertical direction (e.g., raised). If the tilt roller 1 is then rotated in an opposite second direction (with rotation of the drive shaft 2 in its opposite second direction and movement of the driving means [not shown] in its opposite second direction) which will move the bottom of the tilt pin downwardly in FIG. 3, this will result in the bottom of the tilt pin 3 moving, at the first junction 14A, downwardly from the right linear groove 12A to the convoluted groove 13A and thereafter moving downwardly in the portion 13A' of the convoluted groove 13A on the right side of the free zone 12 while the blind slats B are tilted towards a first closed position (e.g., slanted upwardly) and moved in a vertically opposite, second direction (e.g., lowered). If the tilt roller 1 then continues to be rotated in the second direction, the bottom of the tilt pin 3 will continue to move downwardly in the right portion 13A' of the convoluted groove 13A in FIG. 3 and then downwardly in the portion 13A" of the convoluted groove 13A on the left side of the free zone 12 while the blind slats B are tilted towards an opposite second closed position (e.g., slanted downwardly) and continue to be moved in the second vertical direction (e.g., lowered). If the tilt roller 1 then continues to be rotated in the second direction, the bottom of the tilt pin 3 will continue to move downwardly in the left portion 13A" of the convoluted groove 13A and then move downwardly, at the second junction 14B, from the left portion of the convoluted groove to the left linear groove 12B of the free zone 12 and thereafter continue to move downwardly in the left linear groove 12B while the blind slats B are tilted in a open position (e.g., slanted downwardly) and continue to be moved in the second vertical direction (e.g., lowered). If the tilt roller 1 is then rotated in the first direction again (with rotation of the drive shaft 2 in its first direction and movement of the driving means [not shown] in its first direction) which will move the bottom of the tilt pin upwardly in FIG. 3, this will result in the bottom of the tilt pin 3 moving, at the second junction 14B, upwardly from the left linear groove 12B to the left portion 13A" of the convoluted groove 13A and thereafter moving upwardly in the left portion of the convoluted groove while the blind slats B are tilted towards the second closed position (e.g., slanted downwardly) and moved in the first vertical direction (e.g., raised). If the tilt roller 1 then continues to be rotated in the first direction, the bottom of the tilt pin 3 will continue to move upwardly in FIG. 3: i) in the left portion 13A" of the convoluted groove 13A; ii) then in the right portion 13A' of the convoluted groove while the blind slats B are tilted towards the first closed position (e.g., slanted upwardly) and continue to be moved in the first vertical direction (e.g., raised); iii) then, at the first junction 14A, from the right portion 13A' of the convoluted groove to the right linear groove 12A; and iv) then in the right linear groove 12A while the blind slats B are tilted in a open position (e.g., slanted upwardly) and continue to be moved in the first vertical direction (e.g., raised).

Separate tilt drive units A of FIGS. 1–3 can be provided on longitudinally opposite side of a blind, and each tilt drive unit can be connected to a separate ladder cord 8 on longitudinally opposite sides of the blind.

Figure 4:
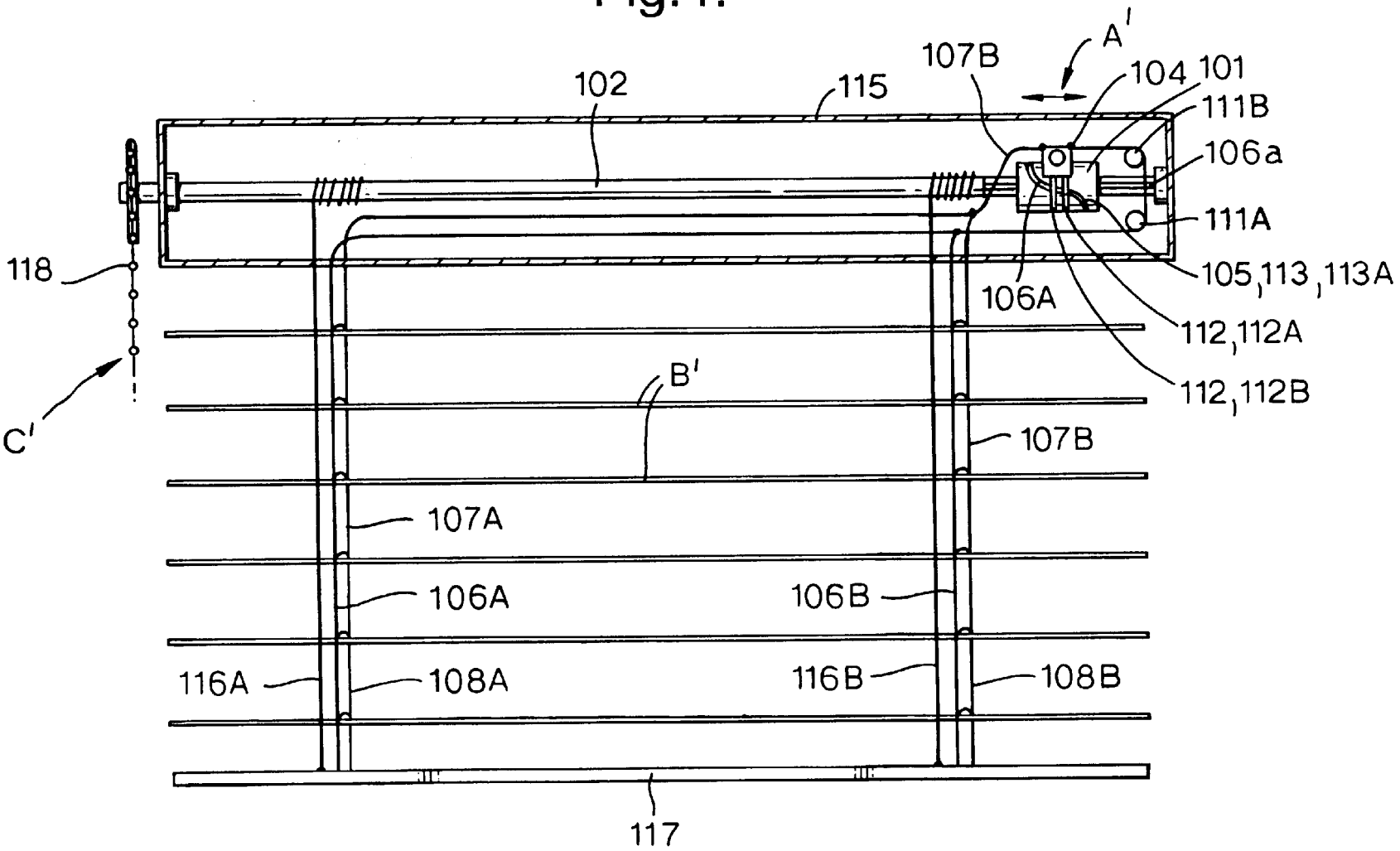
FIG. 4 is a schematic front elevation of a second embodiment of a tilt drive unit of this invention for a horizontal venetian blind (also shown)

However, FIG. 4 shows a second embodiment A' of a tilt drive unit of this invention which is similar to the tilt drive unit A of FIGS. 1–3 and for which corresponding reference numerals (greater by 100) are used below for describing the same or corresponding parts. The single tilt drive unit A' can be provided in a head rail 115 of an otherwise conventional, horizontal venetian blind C' and can be connected to the upper ends of both ladder cords 108A and 108B. As a result, the single tilt drive unit A' can tilt the horizontal blind slats B' and keep the slats tilted open during raising and lowering of the blind.

As seen from FIG. 4, the sole tilt drive unit A' of the venetian blind C' includes a single tilt roller 101 that is in a rigid housing (not shown), mounted on the head rail 115. The tilt roller 101 is connected to, and can rotate with, a conventional drive shaft 102. At one longitudinal end of the head rail 115, preferably the end opposite to the end where the tilt drive unit A' is located, a conventional operating ball chain 118 is provided as a driving means for turning a longitudinal end of the drive shaft 102 in opposite directions. The upper ends of the lift cords 116A and 116B are each wound on individual portions of the drive shaft 102 or on spools on the drive shaft. The lower end of each lift cord 116A, 116B is attached to a bottom rail 117.

The bottom end of a tilt pin (not shown), on the bottom surface of a cord transport member 104, is located within and can move within a grooved circumferential track 105 in the radially outer surface of the tilt roller 101, beneath the cord transport member. The track 105 comprises a pair of laterally-extending linear grooves 112A and 112B in a free zone 112 and a laterally and longitudinally extending convoluted groove 113A in a tilt zone 113. One-way junctions 114A and 114B connect the linear grooves 112A and 112B to the convoluted groove 113A.

The cord transport member 104 of the tilt drive unit A' simultaneously drives both ladder cords 108A, 108B. As shown in FIG. 4, the rear upper end portions 107B of the right ladder cord 108B are attached to the top of the cord transport member 104, preferably at about the lateral middle of the cord transport member, and on its left side, and the front upper end portions 106B of the right ladder cord 108B are attached to the head rail 115. As also shown in FIG. 4, the front upper end portions 106A of the left ladder cord 108A pass around a pair of guiding wheels 111A and 111B on the housing (not shown) for the tilt roller 101 and then are attached to the top of the cord transport member 104, preferably at about the lateral middle of the cord transport member, on the left side of the cord transport member, and the rear upper end portions 107A of the left ladder cord 108A are attached to the head rail 115. As further shown in FIG. 4, the guiding wheels 111A and 111B are preferably located on the right side of the housing for the tilt roller, with one guide wheel 111A being near the bottom of the housing and the other guiding wheel 111B being near its top. Thereby, the front upper end portions 106A of the left ladder cord 108A form a loop 106*a* around the guiding wheels 111A and 111B.

Figure 5:
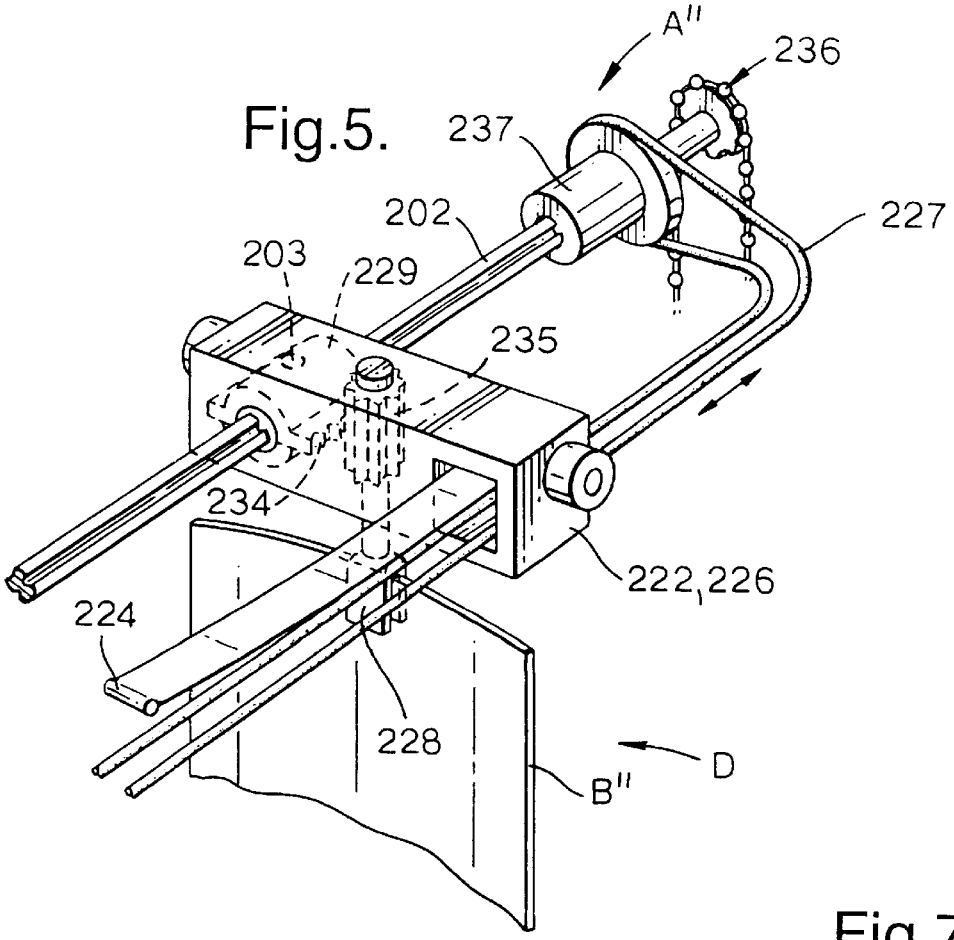
FIG. 5 is a perspective view of a third embodiment of a tilt drive unit of this invention for a vertical venetian blind.

Operation of the tilt drive unit A' of the venetian blind C' is as follows. When the bottom end of the tilt pin (not shown), on the bottom surface of the cord transport member 104, is located within, and moves laterally within, one of the laterally extending linear grooves 112A or 112B in the free zone 112 of the circumferential track 105 on the surface of the tilt roller 1 with rotation of the tilt roller in a first direction (with rotation of the drive shaft 102 in its first direction and movement of the ball chain 118 in its first direction), the slats B' remain in a tilted-open position as the lift cords 116A and 116B are wound up or down with rotation of the drive shaft to open or close the blind C'. When the bottom end of the tilt pin 103 is located within, and moves laterally and longitudinally within, the laterally and longitudinally-extending convoluted groove 113A in the tilt zone 113 of the circumferential track 105 of the tilt roller 1 with rotation of the tilt roller in an opposite second direction (with rotation of the drive shaft 102 in its opposite second direction and movement of the ball chain 118 in its opposite second direction), the cord transport member 104 moves laterally with its tilt pin 103 and thereby pulls either the rear upper end portions 107B of the right ladder cord 108B or the front upper end portions 106A of the left ladder cord 108A laterally, so that the remainder of the right ladder cord 108B or the left ladder cord 108A moves upwardly and simultaneously allows the other upper end portions 106A or 107B of a ladder cord to move laterally under the weight of the remainder of its ladder cord, so that the remainder of that ladder cord moves downwardly, thereby tilting the slats B' in one direction towards a closed position. FIG. 5 shows a third embodiment A" of a tilt drive unit of this invention which is similar to the tilt drive unit A of FIGS. 1–3 and for which corresponding reference numerals (greater by 200) are used below for describing the same or corresponding parts. The single tilt drive unit A" can be provided in a head rail (not shown) of an otherwise conventional, vertical venetian blind D" to tilt the vertical blind slats B" and keep the slats tilted open during opening and closing of the blind.

Figure 7:
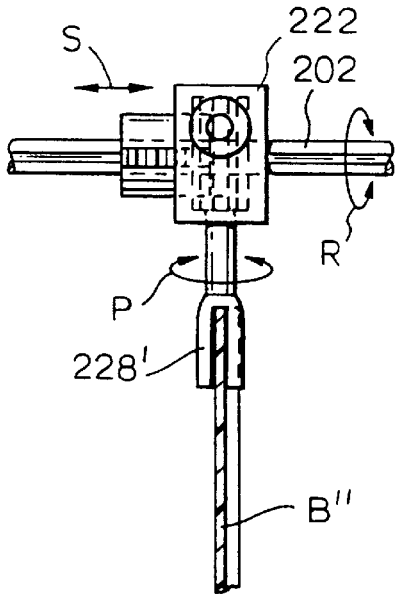
FIG. 7 is a partial side view of the third embodiment of the tilt drive unit, shown in FIG. 5.
Figure 6:
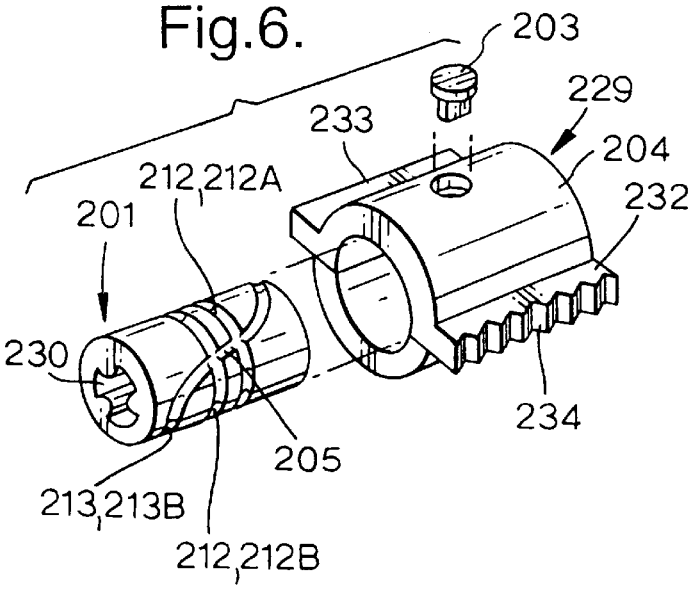
FIG. 6 is an exploded view of the third embodiment of the tilt drive unit, shown in FIG. 5.

As shown in FIGS. 5–7, the blind D has a track 220, along the length of which a plurality of carriers or travelers 222 is slidably suspended to move the slats B" from a retracted (or open) position to an extended (or closed) position. The carriers 222 are interconnected by conventional spacers, such as telescoping spacer strips 224. One of the carriers 222, usually referred to as a "master carrier" 226, is connected to the ends of a looped, longitudinally-extending transport cord 227, to pull all the carriers in succession from the retracted to the extended position and vice-versa.

In accordance with this invention, the looped transport cord 227 is drivingly coupled with a longitudinally-extending drive shaft 202, which extends the length of the head rail (not shown) and traverses each and every carrier 222. The drive shaft 202 drives a slat hanger 228 on each carrier through a tilt drive unit 229, which is shown in more detail in FIG. 6. Each tilt drive unit 229 of a carrier comprises a tilt roller 201 which has a circumferential track 205 around its outer circumference. The tilt roller 201 is adapted to be rotatably driven by the drive shaft 202 but also to be freely slidable along the length of the drive shaft 202 to allow the carriers 222 to move freely in a longitudinal direction. To this end, the drive shaft 202 is in the form of a splined shaft, and each tilt roller 201 has a central bore 230 with a complementary contour to the splined drive shaft 202. Each tilt roller 201 is mounted as shown in FIGS. 5 and 7, so that it is, at least partly, surrounded by a movable tilt member 204 in the form of movable sleeve which is axially slidable with respect to the tilt roller 201. A freely rotatable tilt pin 203 is inserted radially in the movable sleeve 204, so that the tilt pin engages the track 205 of the tilt roller 201 within the movable sleeve. The tilt pin 203, like the tilt pin 3 of FIG. 2, has a bottom end with an oblong shape which moves within, and engages in an aligned fashion, either one of the laterally-extending linear grooves 212A and 212B (equivalent to the linear grooves 12A and 12B of FIG. 3) or the single laterally- and longitudinally-extending convoluted groove 213A (equivalent to the convoluted groove 13A of FIG. 3) of the track 205 on the tilt roller 201. The movable sleeve 204 is provided with front and rear, radially-extending ridges 232 and 233 to prevent the movable sleeve from rotating with the tilt roller 201. The front radially-extending ridge 232 has a rack of gear teeth 234 for engagement with a pinion 235 of the slat hanger 228.

The drive shaft 202, and thereby the tilt roller 201, of the vertical venetian blind D" of FIGS. 5–7 can be rotated in opposite directions by a conventional operating ball chain 236 at one longitudinal end of the head rail (not shown) of the blind. Of course, a conventional electric motor could be used instead. Rotation of the drive shaft 202 by moving the operating chain 236 will both move the transport cord 227, by means of pulley wheel 237, and rotate all the tilt rollers 201 of the tilt drive units 229 of the carriers 222 at the same time. In this regard, continued rotation of the tilt rollers 201 in one direction will result in the tilt pin 203 in each tilt movable sleeve 204 sliding in and engaging one of the circumferential linear grooves 212A or 212B as the blind D is opened or closed with its slats B" in tilted open. Upon each change in rotational direction of the tilt rollers 201, resulting from a change in the direction of rotation of the drive shaft 202 and a change of direction of movement of the operating chain 236, the tilt pin 203, engaging each tilt roller 201, will first enter the convoluted groove 213A of the track 205 and, as a result, will move the sleeve member 204 and thereby tilt the slats B" through movement of the rack teeth 234 of each movable sleeve, relative to its engaged hanger pinion 235, thereby tilting the slats B" towards a closed position. At the same time, movement of the master carrier 226 with movement of the transport cord 227 may occur, thereby partially opening or closing the blind. Although such movement of the master carrier 226 is generally insignificant, it may be eliminated by providing a conventional lost motion arrangement (not shown) between either the drive shaft 202 and the pulley wheel 237 or between the transport cord 227 and the master carrier 226. Continued rotation of the drive shaft 202 in the same rotational direction will then bring the tilt pin 203 into one of the linear grooves 212A or 212B for full transport of the carriers 222 after the slats B" have all returned to a position perpendicular to the drive shaft 202.

FIG. 7 shows the relative movements of the various components, described above, when tilting the slats B" of the vertical blind D. Arrow "R" indicates the possible rotational movements of the drive shaft 202. During engagement of the tilt pin 203 of each movable sleeve 204 with the convoluted groove 213A of the track 205 of the tilt roller 201, the movable sleeve will move longitudinally in either direction as shown by double arrow "S". This will result in corresponding pivotal movement of each slat hanger 228 as indicated by arrow "P". FIG. 7 also shows that each movable sleeve 204 can move longitudinally of its carrier 222. As tilting of the slats B" is usually only required in the extended or closed position of the blind, longitudinal movement of each movable sleeve 204 relative to its carrier 222 should not present any problem as the carriers will then be separated from each other by a maximum spacing.

This invention is, of course, not limited to the above-described embodiments which may be modified without departing from the scope of the invention or sacrificing all of its advantages. In this regard, the terms in the foregoing description and the following claims, such as "longitudinal", "lateral", "radially", "upwardly", "downwardly", "front", "rear", "beneath", "right" and "left", have been used only as relative terms to describe the relationships of the various elements of the tilt drive unit of the invention for coverings for architectural openings. For example, kinematic inversions of the elements of the tilt drive units, described above, are to be considered within the scope of the invention.

What is claimed is:

1. Tilt drive unit for a covering for an architectural opening, such as venetian blind, the tilt drive unit including:

a roller having a circumferential track formation on a radially outer surface thereof and the roller being adapted to be rotatably driven; and a movable tilt member that is engaged by the circumferential track formation on the roller for sliding movement in the track formation and is operatively engaged with means to tilt slats of the covering; and wherein the track formation is non-uniform having a free zone and a tilt zone, whereby when the tilt member is engaged by the free zone, the slats will be retained in the open position and whereby when the tilt member is engaged by the tilt zone, rotation of the roller will cause the slats to be tilted to either of two opposite positions of tilt.

2. Blind including a head rail and a plurality of slats, suspended by the head rail for retraction and extension by a common drive system and which slats are adapted to be tilted by the common drive system between a closed position substantially parallel to a plane common to a longitudinal center axis of each slat and an open position in which the slats are generally perpendicular to the plane common to the longitudinal center axes of the slats, wherein the blind is provided with a tilt drive unit comprising a roller having a circumferential track formation on a radially outer surface thereof and the roller being adapted to be rotatably driven; and a movable tilt member that is engaged by the circumferential track formation on the roller for sliding movement in the track formation and is operatively engaged with means to tilt slats of the covering; and wherein the track formation has a free zone and a tilt zone, whereby when the tilt member is engaged by the free zone, the slat will be retained in the open position and whereby when the tilt member is engaged by the tilt zone, rotation of the roller will cause the slats to be tilted to either of two opposite positions of tilt.

3. Blind according to claim 2, wherein the common drive system includes a drive shaft, rotatable about its longitudinal axis and positioned lengthwise of the head rail.

4. Blind according to claim 3, wherein the slats extend horizontally and are suspended by at least two ladder cords.

5. Blind according to claim 3, wherein the slats extend vertically and are each suspended by a pivotable slat hanger.

6. Blind according to claim 2, wherein the slats extend horizontally and are suspended by at least two ladder cords.

7. Blind according to claim 6, wherein the plurality of horizontally extending slats are interconnected by the at least two ladder cords and can be raised and lowered by the common drive system and wherein the blind is provided with a tilt control mechanism.

8. Blind according to claim 7, wherein the tilt control mechanism will retain the slats in the open position during raising and lowering of thereof.

9. Blind according to claim 2, wherein the slats extend vertically and are suspended by a pivotable slat hanger.

10. A method for maintaining horizontal slats of a blind in an open position wherein the slats are suspended by cord ladders and can be raised and lowered by a drive system, comprising the steps of:

suspending the slats from a head rail for retraction and extension by a common drive system and wherein the slats are adapted to be tilted by the common drive system between a closed position substantially parallel to a plane common to a longitudinal center axis of each slat and an open position in which the slats are generally perpendicular to said plane, providing said drive system with a roller having a circumferential track formation on a radially outer surface thereof, the roller being adapted to be rotatably driven, and providing a movable tilt member that is engaged in the circumferential track formation on the roller for sliding movement in the track formation and is operatively engaged with means to tilt said slats, and wherein the track formation is non-uniform having a free zone and a tilt zone, and engaging said tilt member in said track formation such that when the tilt member is engaged in said free zone, the slats will be retained in the open position and when the tilt member is engaged in the tilt zone, rotation of said roller will cause the slats to be tilted to either of two opposite positions of tilt.

11. The method of claim 10, further including the step of raising and lowering the slats while the slats are in an open position.

12. Tilt drive unit for a covering for an architectural opening, such as venetian blinds, the tilt drive unit including:

a roller having a circumferential track formation on a radially outer surface thereof and the roller being adapted to be rotatably driven; and a movable tilt member that is engaged by the circumferential track formation on the roller for sliding movement in the track formation and is operatively engaged with means to tilt slats of the covering; and wherein the track formation has a free zone and a tilt zone and wherein the free zone includes a substantially linear, pair of circumferential grooves and the tilt zone includes a convoluted groove which intersects the pair of linear grooves, whereby when the tilt member is engaged by the free zone, the slats will be retained in the open position and whereby when the tilt member is engaged by the tilt zone, rotation of the roller will cause the slats to be tilted to either of two opposite positions of tilt.

13. Tilt drive unit according to claim 12, wherein the convoluted groove is connected with a first one of the pair of linear grooves by a first junction and with a second one of the pair of lineal grooves by a second junction.

14. Tilt drive unit according to claim 13, wherein the first junction is adapted to divert the tilt member when the roller is rotatably driven in a first circumferential direction of the roller and the second junction is adapted to divert the tilt member when the roller is rotatably driven in a second circumferential direction, opposite to the first circumferential direction.

* * * * *